United States Patent [19]

Ryffel

[11] 4,439,669

[45] Mar. 27, 1984

[54] INSTANTANEOUS ELECTRODE-TYPE WATER HEATER

[76] Inventor: Louis Ryffel, 332 Blue Hill Ter., Wyckoff, N.J. 07481

[21] Appl. No.: 438,451

[22] Filed: Nov. 1, 1982

[51] Int. Cl.[3] ..... H05B 3/60; F22B 1/30

[52] U.S. Cl. ..... 219/289; 219/291; 219/293; 338/80

[58] Field of Search ..... 219/284–295, 219/271–276; 338/80–86

[56] References Cited

U.S. PATENT DOCUMENTS

| | | | |
|---|---|---|---|
| 957,667 | 5/1910 | Fuller | 219/291 |
| 987,658 | 3/1911 | Wallmann | 219/293 |
| 1,386,607 | 8/1921 | De Raignau | 219/293 |
| 1,827,639 | 10/1931 | Boschetti | 219/293 |
| 1,941,584 | 1/1934 | Sexton | 219/291 |
| 1,999,962 | 4/1935 | Des Rosiers | 219/293 |
| 2,444,508 | 7/1948 | Horni | 219/289 X |
| 4,092,519 | 5/1978 | Eaton-Williams | 219/284 |

*Primary Examiner*—A. Bartis
*Attorney, Agent, or Firm*—William P. Keegan

[57] ABSTRACT

An electrode-type water heater or steam generator constructed from only three different manufactured parts includes an electrically non-conductive housing formed from a pair of complementary identical open-face housing sections. The housing sections each have a plurality of spaced grooves on the interior surface thereof and a port in one end wall. One of the housing sections is inverted and secured face-to-face to the other housing section to form a hollow housing having an inlet port in one end, an outlet port in its other end and a series of spaced, parallel, continuous grooves on its inner surface. A plurality of identical disk-shaped carbon electrodes are each supported in a different one of the continuous grooves and are apertured to allow flow of water through the housing from the inlet port to the outlet port. Identical electrical connectors are provided for energizing the electrodes and each passes through an aperture in the side wall of the housing into a different electrode, with each housing section having a connector apertures communicating with alternate grooves.

3 Claims, 3 Drawing Figures

INSTANTANEOUS ELECTRODE-TYPE WATER HEATER

FIELD OF THE INVENTION

This invention relates to electric hot water heaters and steam generators, and more particularly to instantaneous heaters in which water is heated or steam generated by the conductance of electricity through water supplied to the apparatus.

BACKGROUND OF THE INVENTION

Instantaneous hot water heaters are well known in the art, and are exemplified, for example, by the disclosures in U.S. Pat. Nos.: 987,658; 1,362,356; 1,738,360; 1,827,639; 1,941,584; 1,952,774; 2,807,702; and 4,119,833. The prior art heaters are unduly complicated and comprise many different parts or components which render them expensive to manufacture and difficult to assemble. Also, the complexities of such heaters make them susceptible to malfunctioning or water leakage.

BRIEF DESCRIPTION OF THE INVENTION

It is the object of the present invention to provide an improved instantaneous hot water heater.

It is another object of the invention to provide an instantaneous hot water heater that may also serve as a steam generator.

Another object of the invention is to provide an instantaneous electric hot water heater comprising a minimum number of parts or components.

Yet another object of the invention is to provide an instantaneous electric hot water heater that is easy to manufacture and assemble.

Still another object of the invention is to provide an electric hot water heater that comprises non-moving components.

In carrying out the invention, a water heater housing formed of two identical housing members support a plurality of identical spaced carbon disk-shaped electrodes that are provided with apertures for the passage of water therethrough. The carbon electrodes are supported in spaced apart grooves formed on the interior surface of the housing members. Electrical connectors projecting through the housing enable connection of the carbon electrodes to a source of electricity, preferably through a control device external to the water heater. Pipe fittings may be provided at opposite ends of the housing for feeding water into and out of the heater.

Features and advantages of the invention may be gained from the foregoing and from the description of a preferred embodiment of the invention which follows.

Figure 1:
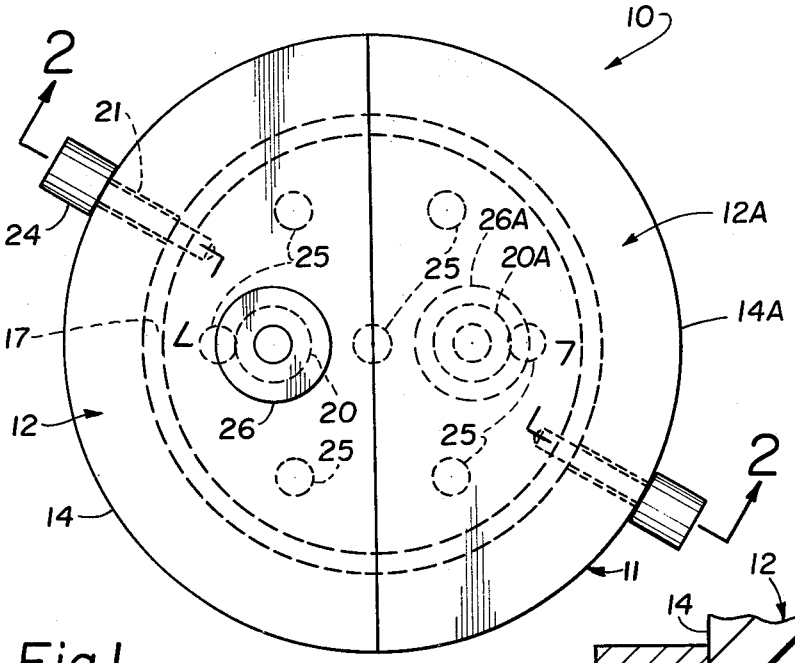
FIG. 1 is a top plan view of the water heater of the present invention.

Referring now to the drawing, it will be seen that the instantaneous electric hot water heater 10 comprises a housing 11 formed of two identical members 12 and 12A, one member being inverted and rotated 180° about a vertical axis with respect to the other member. Members 12 and 12A are formed with semicylindrical sidewalls 14, 14A and semicircular end walls 15, 16, and

Figure 2:
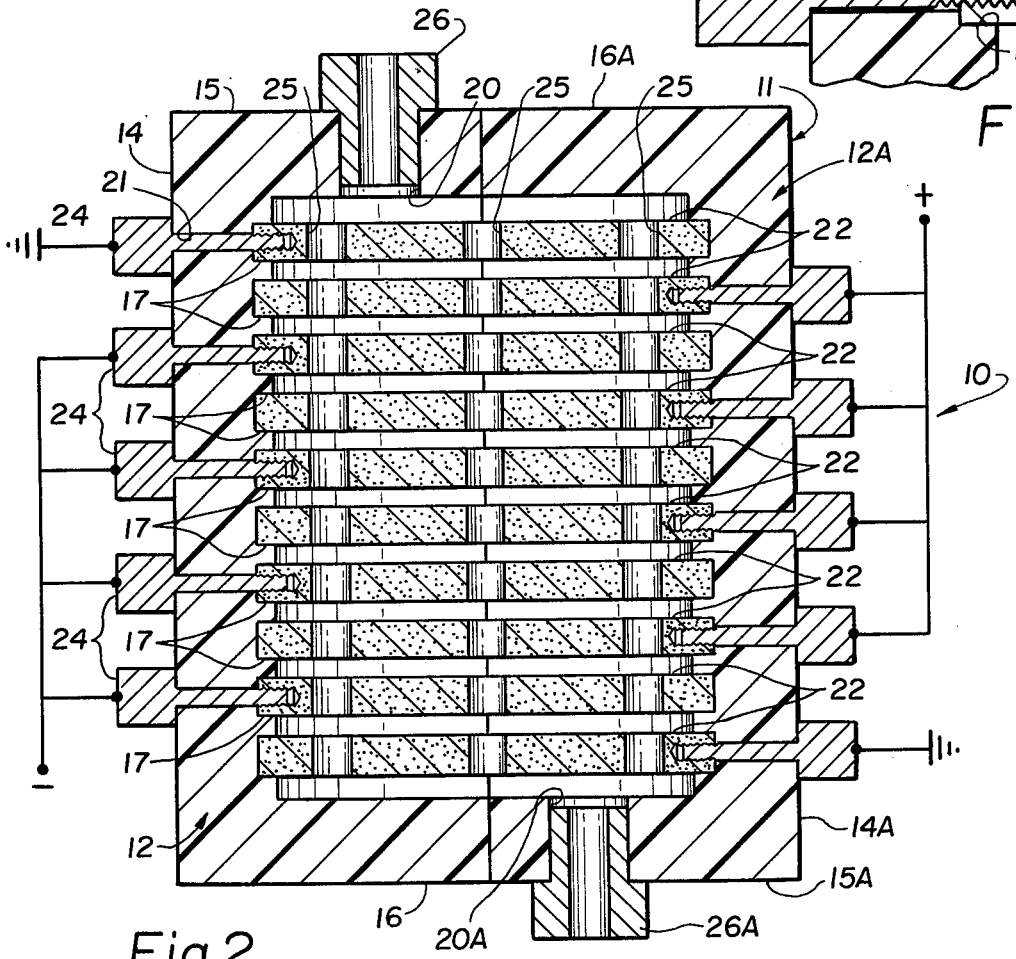
FIG. 2 is a front sectional view of the heater taken along line 2—2 of FIG. 1.

15A, 16A, respectively. These sidewalls 14, 14A are provided on the peripheries of their interior surfaces with a plurality of spaced-apart semi-circular grooves 17, while the endwalls 15, 15A are provided with circular ports 20, 20A. A plurality of apertures 21 extend through sidewalls 14, 14A into alternate grooves 17 of the housing members 12, 12A beginning with the groove closest to end walls 15, 15A. It is clear that by joining the two members 12 and 12A so that the edges of end walls 15, 16 of one member abut the edges of the end walls 16A, 15A, respectively, of the other, and vice versa, an integral hollow housing 11 having eccentrically positioned ports 20, 20A at the top and bottom thereof (see FIG. 2) is provided. Also, the housing 11 will have an aperture 21 extending into each groove 17 even though members 12 and 12A are provided only with apertures extending into alternate grooves.

It is to be noted that member 12 is integrally formed of a suitable plastic resin having a low coefficient of expansion. Moreover, the member is preferably formed by molding so that a finished member, having all required apertures therein, is formed in one manufacturing operation.

The electrodes 22 are carbon disks having a thickness essentially the same as the width of the grooves 17 on sidewalls 14, 14A of housing 11. Each electrode 22 is provided with a threaded hole 23 into which an electrical connector 24 can be screwed as well as a plurality of apertures 25 through which water to be heated will pass when heater 10 is assembled and in use.

Figure 3:
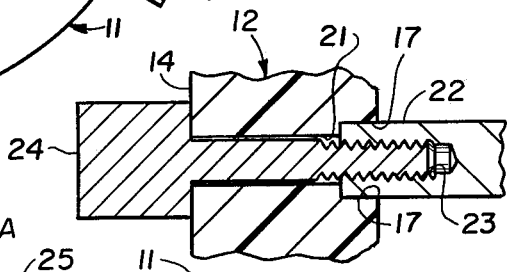
FIG. 3 is an enlarged fragmentary detail view showing the electrical connection to an electrode.

To assemble heater 10, a sub-assembly is formed by placing a plurality of electrodes 22 in alternate grooves 17, beginning with the topmost groove (see FIG. 2) of housing member 12 with threaded hole 23 of each electrode 22 aligned with aperture 21 in sidewall 14. See FIG. 3. An electrical connector 24 is then inserted through each aperture 21 and screwed into electrodes 22, thus holding it in place in groove 17. An epoxy resin can be used to assure that each aperture 21 is water tight after a connector 24 is inserted therethrough. Then, a second identical sub-assembly 12A, inverted and rotated 180° about a vertical axis with respect to the first sub-assembly, is joined to the first sub-assembly as shown in the drawing. An epoxy resin can be used to join the sub-assemblies to form a water-tight heater 10. It is noted that the electrodes 22 of the two sub-assemblies will interleave when the sub-assemblies are joined together. Fittings 26, by which water inlet and outlet pipes or tubing can be connected to heater 10, may be secured in ports 20, 20A in the top and bottom walls of the heater 10 by an epoxy resin. Preferably, however, heater 10 is supplied without fittings so that the appropriate type of fitting can be selected and applied to the heater at the installation site.

Alternate electrodes 22, such as those connected to the electrical connectors 24 shown on the left side of heater 10 (FIG. 1), will be connected through a control device (not shown) to one line of an electric power source, while the remaining electrodes 22 will be connected through connectors 24 shown on the right side of the heater to the other line of the power source. The end electrodes 22, i.e., those adjacent the top and the bottom of heater 10, are connected to ground to obviate any shock hazard when the heater is in use.

The external control device may respond, for example, to a thermostat to switch heating elements into and out of operation to control the temperature of the water. In fact, the temperature of the water may be raised to the point where heater 10 becomes a steam generator. Also, manual means may control the switching of electrodes into and out of operation. As previously noted, such control devices form no part of the present invention.

In summary, it is emphasized that the instantaneous hot water heater of the present invention comprises essentially only three different parts, namely: a housing member, two of which make up the heater housing; an electrode, a plurality of which are provided in the heater, the number of which depends on the water volume and temperature requirements of a particular heater; and an electrical connector, one for each electrode provided.

Having thus described the invention, it is to be understood that many apparently widely different embodiments thereof can be conceived without departing from the spirit and scope thereof. For example, the configuration of apertures 25 in electrodes 22 can be varied. Heater 10 could be assembled in a manner different than that described. Therefore, it is intended that the foregoing description and the accompanying drawing be inerpreted as illustrative rather than in a limiting sense.

What is claimed is:

1. An instantaneous electric hot water heater comprising: an electrically non-conductive housing formed of two identical complementary members, each of which is provided with sidewall means open at one side and end walls, said sidewall means having spaced apart grooves formed on the interior surfaces thereof parallel to said end walls and apertures extending through said sidewall means into alternate ones of said spaced apart grooves, and one end wall having a port formed therein, one of said members being inverted and joined to the other member with open sides thereof facing each other to form a water-tight hollow housing having a port in each of the opposite ends thereof and in which the grooves formed in each member are aligned and form a plurality of spaced apart continuous grooves on the interior surface of said housing; a plurality of electrodes extending transversely across the interior of said housing, each such electrode being supported in a different groove of said plurality of continuous grooves formed in said housing and being adapted to make electrical contact with an electrical connector projecting through an aperture in the sidewall of said housing into the groove, each electrode being provided with a plurality of apertures for the passage of water through the electrode; and a plurality of electrical connector means, one for each of said electrodes, each of said connector means projecting through an aperture formed in the sidewall means of said housing into the edge of a different electrode.

2. An instantaneous electric hot water heater according to claim 1 including adhesive means for joining said housing members to each other in a water tight joint and for providing a water tight seal around said electrical connector means extending through the apertures in said housing sidewall.

3. An instantaneous electric hot water heater according to claim 1 including pipe fitting means secured in the port provided in one end of said housing, and second pipe fitting means secured in the port provided in the opposite end of said housing.

* * * * *